US006876831B2

(12) United States Patent
Oohara et al.

(10) Patent No.: US 6,876,831 B2
(45) Date of Patent: Apr. 5, 2005

(54) IMAGE FORMING APPARATUS FOR CONDUCTING SPEED COMPENSATION BY INTERNAL TRANSCRIPTION BELT CYCLE MEASUREMENT

(75) Inventors: Shunichi Oohara, Ushiku (JP); Kazuo Kikuchi, Hitachi (JP); Masashi Yamamoto, Hitachi (JP); Kazuhiro Wakamatsu, Hitachi (JP); Masahiko Saito, Isohara (JP); Yuuichi Takano, Hitachi (JP); Junichi Shoji, Kanasago (JP); Atsushi Onose, Hitachinaka (JP); Satoshi Narita, Hitachiota (JP)

(73) Assignee: Hitachi Prinitng Solutions, Inc., Tokyo (JP)

( * ) Notice: Subject to any disclaimer, the term of this patent is extended or adjusted under 35 U.S.C. 154(b) by 16 days.

(21) Appl. No.: 10/609,583

(22) Filed: Jul. 1, 2003

(65) Prior Publication Data

US 2004/0218947 A1 Nov. 4, 2004

(30) Foreign Application Priority Data

Jul. 1, 2002 (JP) ..... 2002-191577

(51) Int. Cl.[7] ..... G03G 15/00; G03G 15/16

(52) U.S. Cl. ..... 399/302; 399/167; 399/301

(58) Field of Search ..... 399/302, 308, 399/162, 167, 43, 75, 66, 301

(56) References Cited

U.S. PATENT DOCUMENTS 5,270,769 A * 12/1993 Satoh et al. ..... 399/301
5,740,492 A * 4/1998 Deki et al. ..... 399/302 X
5,790,930 A * 8/1998 Fuchiwaki ..... 399/302
2003/0063929 A1 * 4/2003 Oohara et al. ..... 399/302
2003/0091364 A1 * 5/2003 Nishiwaki ..... 399/101

FOREIGN PATENT DOCUMENTS

JP 08-062997 * 3/1996
JP 8-328443 12/1996
JP 2003-107843 * 4/2003

* cited by examiner

*Primary Examiner*—Sophia S. Chen
(74) *Attorney, Agent, or Firm*—Antonelli, Terry, Stout & Kraus, LLP

(57) ABSTRACT

An image forming apparatus includes a photosensitive belt carried by a driver device, for forming a toner image thereon; an internal transcription belt for transcribing the toner image; and a transcription portion for transcribing the toner image, which is transcribed on the internal transcription belt, onto a recording medium. A transcription side roller is suspended with the internal transcription belt thereon, and disposed on a side of a photosensitive belt side roller. Detectors detect a first cycle of the internal transcription belt, and a second cycle, which starts measurement delaying by ½ cycle of the photosensitive belt side roller from the first cycle measurement start. A controller conducts speed compensation of the photosensitive belt by referring to the first cycle and the second cycle, wherein the internal transcription belt is in contact with the photosensitive belt, so that it is carried following thereafter.

9 Claims, 8 Drawing Sheets

IMAGE FORMING APPARATUS FOR CONDUCTING SPEED COMPENSATION BY INTERNAL TRANSCRIPTION BELT CYCLE MEASUREMENT

BACKGROUND OF THE INVENTION

The present invention relates to an image forming apparatus, comprising a photosensitive belt carried or conveyed by a driving device, a plural number of developing means for forming toner images on said photosensitive belt, and an internal transcription means, on which the toner images on said photosensitive belt are transcribed, thereby forming a color image.

With an image forming apparatus, comprising: a photosensitive belt carried by a driving device.; a plural number of developing means for forming toner images on said photosensitive belt; an internal transcription belt, on the surface of which are transcribed the toner images on said photosensitive belt at plural times when forming the images for one page; and a transcription roller for pushing a paper onto said internal transcription belt, so as to transcribe the toner images to the paper, an apparatus is proposed, in which the photosensitive belt and the internal transcription belt are driven, as described in Japanese Patent Laying-Open No. Hei 8-328443 (1996) <JP-A 08-328443>.

Conventionally, in the image forming apparatus, wherein image forming for one page is conducted by putting the toner images formed on the photosensitive belt onto surface of the internal transcription belt at plural times, a driving mechanism is necessary, not only for carry of the photosensitive belt, but also for carry of the internal transcription belt, respectively. In such case, due to decentering (i.e., shift of the center) of gears, rollers, etc., of the respective mechanisms, difference occurs in velocity between the photosensitive belt and the internal transcription belt, thereby causing shift in piling up of colors as a result thereof, and therefore a driving system is necessary, having high accuracy.

If carrying the internal transcription belt by means of the photosensitive belt, i.e., to be driven thereafter, no such shift in piling up of colors occurs due to the difference of velocity of the driving system mentioned above. However, for performing such the carry of the internal transcription belt following after the photosensitive belt, with stability, it is necessary to widen nip widths thereof sufficiently. For that purpose, it is necessary to bring a photosensitive belt side roller, which pushes the internal transcription belt toward the photosensitive belt, to be large, up to a certain degree, in particular, in the diameter thereof. Also, if widening the nip width on the roller of small diameter, winding angle of the belt on the roller comes to be large, thereby increasing the surface tension due to bend of the photosensitive belt and the internal transcription belt, and there occurs creep deformation when being left for a long time. This deformation brings about gap shit between the photosensitive belt and the internal transcription belt when transcribing the toner, and also causing unevenness in concentration of the images. Even from such the viewpoint, it is necessary to keep the diameter of the photosensitive belt side roller to be large, in a certain degree.

At a marker position for measuring a cycle of the internal transcription belt, the velocity of the internal transcription belt is fluctuated upon ill influences given from the decentering of the photosensitive belt side roller. If periphery length of the photosensitive belt side roller is 1/N (N: an integer) of the internal transcription belt, this fluctuation in the velocity will not come to the periodic error. However, if making the photosensitive belt side roller large in the diameter thereof, for obtaining such the effect as was mentioned above, the ratio between the periphery length of the photosensitive belt side roller and the periphery length of the internal transcription belt does not comes to be such the integer, and thereby causing the periodic error. For this reason, if conducting an adjustment on motor speed for fitting the cycle to the standard time, it is done at the time of the carry velocity when the adjustment is inherently unnecessary, thereby causing the shift in piling up of colors.

When bringing the diameter of the photosensitive belt side roller and the periphery length of the internal transcription belt to be the ratio of integer, the periphery length of the internal transcription belt comes to be long, and therefore, a printing time for one page is elongated, as well as, the apparatus comes to be large the sizes thereof.

BRIEF SUMMARY OF THE INVENTION

An object, according to the present invention, is to provide an image forming apparatus enabling printing of high quality, to be small in sizes and fast in printing speed, as well as, to be less in shift in piling up of colors.

According to the present invention, for accomplishing the object mentioned above, there is provide an image forming apparatus comprising: a photosensitive belt being carried by a driver device, for forming a toner image thereon; an internal transcription belt for transcribing the toner image thereon, which is formed on said photosensitive belt; and a transcription portion for transcribing the toner image, which is transcribed on said internal transcription belt, onto a recording medium, further comprising: a transcription side roller, being suspended with said internal transcription belt thereon, and disposed on a side of a photosensitive belt side roller, which is disposed on a side of said photosensitive belt, and a transcription side roller, which is disposed on a side of said transcription side; means for detecting a first cycle of said internal transcription belt; and means for detecting a second cycle, which starts measurement delaying by ½ cycle of said photosensitive belt side roller from the first cycle measurement start; a controller means for conducting speed compensation of said photosensitive belt by referring to said first cycle and said second cycle, wherein, said internal transcription belt is in contact with said photosensitive belt, so that it is carried following thereafter.

Further in more detail, according to the present invention, there is also provided an image forming apparatus, comprising: a photosensitive belt being carried by a driver device, for forming an toner image thereon; an exposure device for forming an electrostatic image on said photosensitive belt; a plural number of developer units for forming a toner image on said photosensitive belt; a transcription roller for pushing a paper onto said internal transcription belt, so as to transcribe the toner image onto the paper; a photosensitive belt side roller wound with said photosensitive belt therearound while putting said internal transcription belt therebetween, to be driven; a transcription side roller being pushed with the paper while putting said internal transcription belt therebetween; a plural number of markers formed in said internal transcription belt; a sensor for detecting said markers; and a calculation means for measuring a first cycle of said internal transcription belt and a second cycle for starting measurement delaying by ½ cycle of said photosensitive belt side roller from the first cycle measurement start, from a marker detection signal of said sensor, for calculating out a compensation amount from an average cycle of said first cycle and said second cycle and a difference with respect to a standard cycle, and for controlling said driver device upon basis of said compensation amount, thereby compensating a carry speed of said photosensitive belt, wherein, preferably, said internal transcription belt is suspended round said photosensitive belt side roller and said transcription side roller, and is in contact with said photosensitive belt, to be carried following thereafter, and the toner images on said photosensitive belt are transcribed on surface of said internal transcription belt, piling up there upon by a plural number of times, when forming an image for one (1) page.

With this, it is possible to cancel the fluctuation of measured cycles due to the decentering of the photosensitive belt side roller, if the photosensitive belt side roller is made in the diameter, and so that if the ratio between periphery length of the transcription belt and periphery length of the photosensitive belt side roller comes out from an integer.

BRIEF DESCRIPTION OF THE SEVERAL VIEWS OF THE DRAWING

Those and other objects, features and advantages of the present invention will become more readily apparent from the following detailed description when taken in conjunction with the accompanying drawings wherein.

DETAILED DESCRIPTION OF THE INVENTION

Hereinafter, embodiments according to the present invention will be fully explained by referring to the attached drawings.

Figure 1:
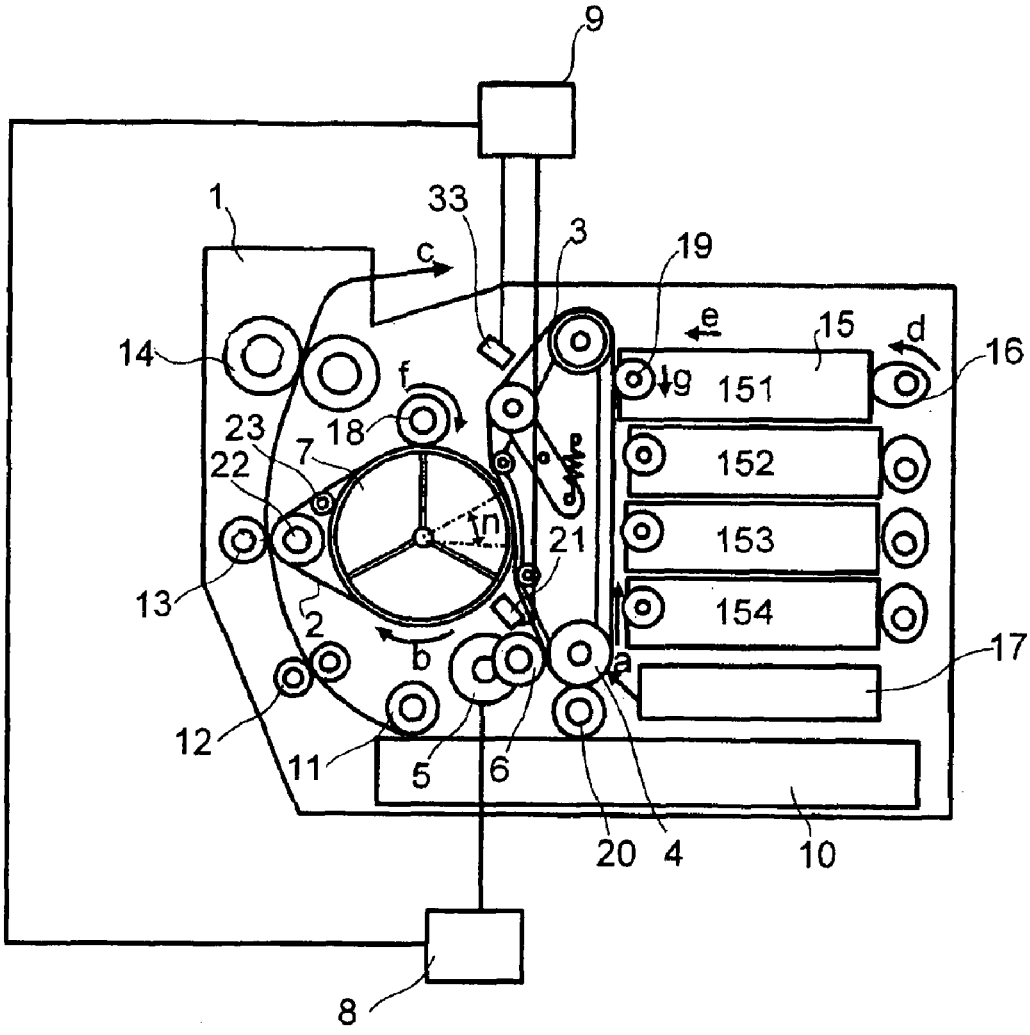
FIG. 1 shows a cross-section view of an image forming apparatus, according to a first embodiment of the present invention.

FIG. 1 shows a side view of the image forming apparatus according to an embodiment of the present invention. This apparatus, in more details, is a color laser printer, which rotates an internal transcription belt 2 four (4) times, thereby enabling to form a color image by piling up images of four (4) colors.

Hereinafter, explanation will be made on each of units, which are disposed within the apparatus 1.

A photosensitive belt 3 is carried in a direction of an arrow "a", by means of a drive roller 4, which is driven by a drive motor 5 through a motor driving system 6. An internal transcription belt 2 is driven by covey power at a nip portion "n" contacting with the photosensitive belt 3, following thereafter.

The photosensitive belt 3 is made up, by forming a conductive layer and a photosensitive layer on a base material made of a resin, such as, polycarbonado, polyethylene terephthalate, and/or polyimide, etc., for example, and it has thickness of 0.075–0.15 mm.

The internal transcription belt 2 is a seamless belt made of a resin, such as, polycarbonado, polyethylene terephthalate, and/or polyimide, etc., for example, and is manufactured to be semiconductor, for conducting the transcription of toner, thereby having a volume resistance of $10^{8-1012}$ Ω/cm. Thickness of this lies 0.075–0.15 mm.

The internal transcription belt 2 is suspended on a photosensitive belt side roller 7 and a transcription side roller 22, and the photosensitive belt 3 is wound around the photosensitive belt side roller 7 at the nip portion "n" through the internal transcription belt 2.

The photosensitive belt side roller 7 has a large diameter, and has a nip width between the photosensitive belt at least 20 mm or more than that. The transcription side roller 22 has a small diameter comparing to that of the photosensitive belt side roller 7.

An internal transcription belt tension roller 23 builds up a tension applying means for the internal transcription belt 2, and it pushes the internal transcription belt 2 by means of a spring or the like, for example.

The drive motor 5 is controlled, so as to maintain a constant rotation speed by the function of a motor driver 8. On the internal transcription belt 2 is formed a marker for measuring the cycle thereof. The marker is a hole opened in the opaque internal transcription belt 2, or rectangular patterns formed thereon alternatively, being different in reflectivity thereof. A sensor B 21 is built up with a penetrative type sensor, in case that the marker is the former, but a reflection type sensor in case of the latter, and detecting passage thereof. In any case, the passage of the marker is converted into a signal of "1" or "0" in a detection signal processor 96, to be counted by a CPU 91, and-thereby-the cycle is measured through a number of clocks counted up when counting up one cycle. And, an instruction is given to the motor driver 8, so that the internal transcription belt 2 be carried at the standard cycle, i.e., compensating the speed of the motor 5, and thereby changing the carry speed of the photosensitive belt 3.

A developer unit, as a means for developing, storages toner therein, and forms the toner into a thin layer on a developing roller 19. When forming the toner image on the photosensitive belt 3, a retract means 16 is rotated in a direction of an arrow "d", so as to advance the developer unit 15 into a direction "e", and thereby bringing the developer roller 19 to be in contact with the photosensitive belt 3. After forming the image, the retract means 16 is rotated further in the direction of arrow "d", thereby leaving the developer unit 15 away therefrom.

A fur-brush 18 removes the toner remaining on the internal transcription belt 2, after transcribing the image on the internal transcription belt 2 to a paper, by means of a retract mechanism not sown in the figure, and thereafter it leaves away therefrom.

A transcription roller 13 pushes a paper toward the internal transcription belt 2 in a transcription process, by means of the retract mechanism not shown in the figure, and it leaves away therefrom after the paper passes through the transcription roller 13.

A paper cassette 10 for storing paper therein is disposed almost horizontally, in a lower portion of the apparatus, with respect to a plane on which the apparatus is set.

Above a paper carry passage "c" are disposed the paper cassette 10, and also a pickup roller 11, a resist roller 12, the transcription roller 13, and a fixing apparatus 14.

The fixing apparatus 14 is built up with two (2) pieces of roller or belts, which are heated, and thereby melting the toner image through heat and pressure applied on the paper, so as to fix it thereon.

Figure 2:
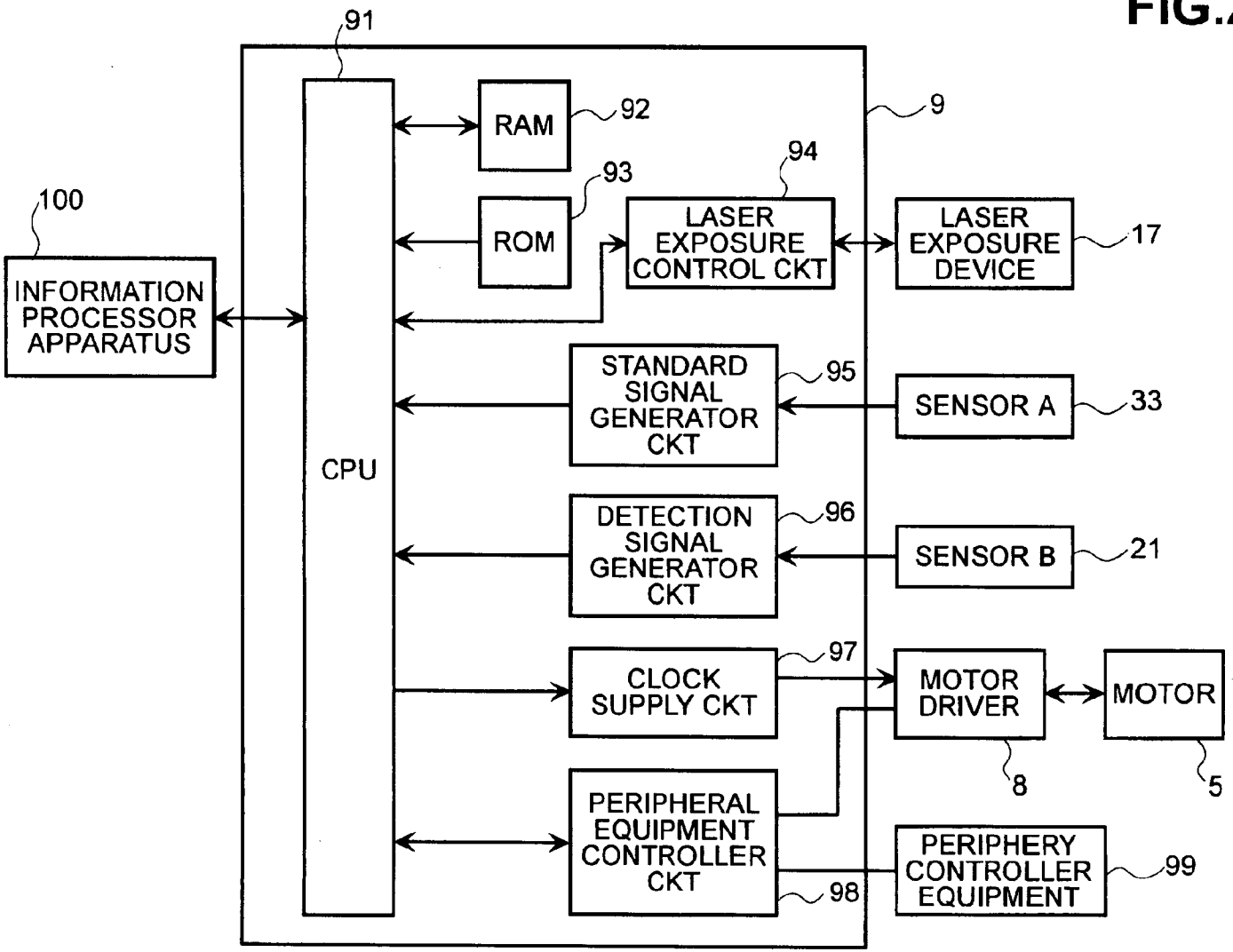
FIG. 2 shows a block diagram of a controller, according to the first embodiment of the present invention.

FIG. 2 is a block diagram of a controller, according to the embodiment of the present invention.

A controller 9 is mainly built up with the CPU 91, and it also comprises: a ROM 93 storing control programs therein; a RAM 92 storing control parameters; a laser controller circuit 94 controlling a laser exposure device; a reference signal generator circuit 95, detecting the marker on the photosensitive belt 3 and generating a reference signal for staring the forming of image; a detection signal processor circuit 96 for detecting the marker on the internal transcription belt 2, thereby detecting the cycle thereof; a clock supply circuit 97, being controlled by the CPU, to supply a reference clock for controlling the rotation speed to the motor controller, which drives the photosensitive belt; and a control/drive circuit 98 for controlling peripheral equipment 99, such as the retract mechanisms, etc., within the image forming apparatus.

Next, explanation will be made on processes for forming the image.

Upon a printing request from an information processing apparatus 100, each element is turned into operation condition according to the control program. When the marker on the photosensitive belt 3 is detected by means of the sensor A 33, the photosensitive layer of the photosensitive belt 3 is electrified by means of an electrifying roller 20, after passing a predetermined time therefrom, and an image signal transmitted from the information processing apparatus is transferred to the laser exposure controller circuit 94, thereby forming an image on the photosensitive belt through blinking a laser beam from the laser exposure device 17.

Next, while rotating the developing roller 19, on which the toner in the developing unit 15 adheres, the developing roller 19 is in contact with the photosensitive belt 3, thereby forming a toner layer on the photosensitive belt 3, corresponding to the image.

In the present embodiment, for the purpose of forming a uniform toner image, the developing roller is rotated in the same direction of the photosensitive belt 3, i.e., in the direction of arrow "g", and the peripheral velocity of the roller is set to be faster than that of the photosensitive belt 3.

The toner layer formed on the photosensitive belt 3 is transcribed on the internal transcription belt 2 once, at the nip portion "n" defined between the internal transcription belt 3. The color laser printer has developer units 151, 152, 153 and 154 for four (4) colors, such as, black, yellow, magenta, and cyan, and therefore the images, each being formed on the photosensitive belt 3 for each color, are piled up on the internal transcription belt 2, thereby forming the color image.

Each of the papers stored in the paper cassette 10 is taken out by one piece, by means of the pickup roller 11, and it is amended in skew thereof by means of the resist roller 12. And, just before the tip of the paper reaches to a position defined between the transcription roller 13 and the internal transcription belt 2, a retract means not shown in the figure pushes the transcription roller toward the internal transcription belt 2, and pushes the paper onto the internal transcription belt 2. In this instance, high voltage is applied to the transcription roller 13, and thereby the toner image on the internal transcription belt is transcribed onto the paper.

Thereafter, the paper reaches to the fixing apparatus 14, and the toner image on the paper is fixed thereon through heat and pressure.

Residual image remaining on the internal transcription belt 2 after the image transcription is removed, through bringing the fur-brush 18 to contact with the internal transcription belt 2 and rotating the brush. For increasing capacity of erasing the image thereon, according to the present embodiment, the rotation direction of the brush is. set, not only in the rotation direction of the internal transcription belt 2, but also in the direction of arrow "f" reversing thereto.

Figure 3:
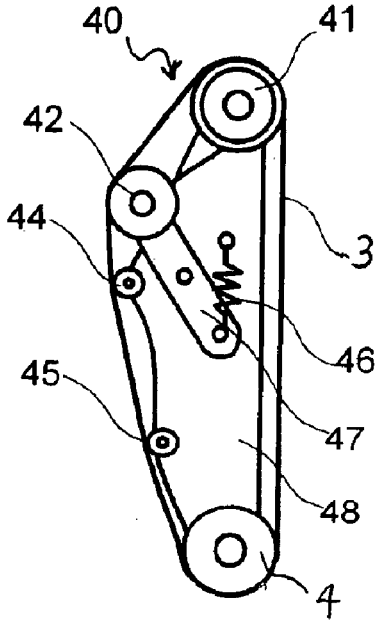
FIG. 3 shows a side view of a photosensitive belt unit, according to the first embodiment of the present invention.

FIG. 3 is a view for showing the structure of the photosensitive belt unit, according to the embodiment of the present invention.

The photosensitive belt 3 is suspended around the drive roller 4, the photosensitive belt tension roller 42, and a driven roller 41. The photosensitive belt tension roller 42 applies the tension onto the photosensitive belt 3 by means of a spring 46, and a tension arm 47.

A first auxiliary roller 44 and a second auxiliary roller 45 defines the width of the nip portion "n" with respect to the internal transcription belt 2. Those are disposed in a photosensitive belt unit frame 48, in a form of the photosensitive belt unit 40.

Figure 4:
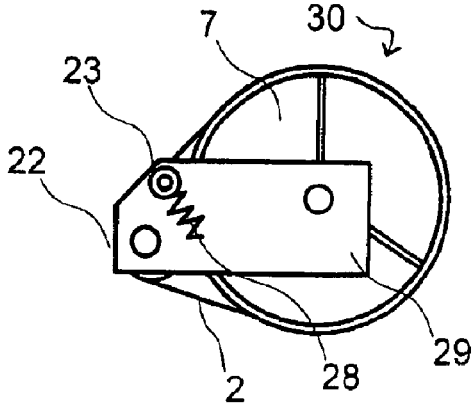
FIG. 4 shows a side view of a internal transcription belt unit, according to the first embodiment of the present invention.

FIG. 4 is a view for showing the structure of the internal belt unit, according to the embodiment of the present invention.

The internal transcription belt 2 is suspended around the 5 photosensitive belt sideroller 7 and the transcription side roller 22, wherein the tension is applied thereto through pushing up the internal transcription belt tension roller 23 by means of the spring 28. Those are disposed within an internal transcription belt unit frame 29, in a form of the internal transcription belt unit 30.

Next, explanation will be given about features of the structure of the present embodiment.

First, carrying of the internal transcription belt 2 following after the photosensitive belt 3 negates necessity of the driving system for it, thereby simplifying the structure thereof. Also, the driving system has periodic fluctuation in the velocity due to the decentering of the drive roller, etc. It is impossible to fit such the fluctuations between the different driving systems for the photosensitive belt 3 and the internal transcription belt 2, and therefore difference is caused in the velocity between the photosensitive belt 3 and the internal transcription belt 2. The velocity difference results into the shift in piling up of colors when transcribing the image from the photosensitive belt 3 onto the internal transcription belt 2. The driving of the internal transcription belt following after the photosensitive belt negates such the ill influences, and therefore it is possible to obtain an image of high-quality without the shift in piling of colors.

On the other hand, for achieving such the driving of the internal transcription belt as mentioned above, stably, with less speed fluctuation, it is necessary to obtain the sufficient driving force for the internal transcription belt 2 of the photosensitive belt 3. The driving force is the sum of the driving force caused due to electrostatic suction acting between the photosensitive belt 3 and the internal transcription belt 2, and the driving force caused due to force when the photosensitive belt 3 pushes the internal transcription belt 2 through the tension of the photosensitive belt 3. Each of those is proportional to the nip width defined between the photosensitive belt 3 and the internal transcription belt 2. For this reason, in order to obtain an appropriate driving force, it is necessary to widen the nip width, i.e., at least 20 mm or more than that, and preferably to be equal 24 mm or more.

Next, it is to have the photosensitive belt side roller 7, on which is wound around the photosensitive belt 3 putting the internal transcription belt 2 therebetween, and the transcription side roller 22, onto which the paper is pushed while putting the internal transcription belt 2 therebetween, and they are suspended around the two (2) pieces of the rollers. With this, it is possible to make a curvature can be made small on the transcription side, and there fore the paper can release from the internal transcription belt 2 by means of rigidity of itself. Therefore, it is not necessary to provide a destaticizer (or a static eliminator) and high-voltage power source, etc., for driving thereof, or in case of providing the destaticizer, the paper can be released from, by means of a simple antistatic brush or the like, therefore can be simplified the structure thereof.

Also, in the case when the transcription side roller 22 is made small in the diameter for improving the releasing property thereof much more, creep deformation occurs along the roller. The gap changes due to this deformation, between the photosensitive belt 3 and the internal transcription belt 2, in the nip portion "n" there between, and the internal transcription belt 2 and the photosensitive belt side roller 7, varies the transcription condition, thereby causing deterioration of the image. According to such the structure, .that the photosensitive belt 3 is wound around the photosensitive belt side roller 7 while putting the internal transcription belt 2 therebeween, it is possible to change the condition that the internal transcription belt 2 is deformed in a convex-like manner directing the photosensitive belt 3, into that the photosensitive belt 3 is suppressed directing to the photosensitive belt side roller 7, therefore the photosensitive belt 3 and the internal transcription belt 2 ,and also the internal transcription belt 2 and the photosensitive belt side roller 7 contact with each other, with certainty, thereby causing no such the deterioration in the image quality.

Further, in a case where the diameter of the photosensitive belt side roller 7 is made large comparing to the diameter of the transcription side roller 22, since the creep deformation comes to be less on the photosensitive belt 3, which is wound round the photosensitive belt side roller 7 at the nip portion "n", if being left for a long time, then no such the gap change occurs between the developer unit 15 and the photosensitive belt 3, and therefore the high-quality image can be obtained for a long time. Further, also the creep deformation of the internal transcription belt 2 is less on the photosensitive belt side roller 7, therefore the photosensitive belt 3 and the internal transcription belt 2, and also the internal transcription belt 2 and the photosensitive belt side roller 7 contact with each other, with certainty, thereby causing no such the deterioration in the image quality. And, it is also possible to ascertain the nip width for driving the internal transcription belt 2 following after the photosensitive belt 3 with stability.

In this instance, preferably the transcription side roller 22 has a size 20–30 mm on the diameter there of, by taking there leasing property and the creep deformation into the consideration. Also, for the photosensitive belt side roller 7, it is preferable to have the diameter being equal or greater than 40 mm, so as to have the less creep deformation, as well as, to ascertain the nip width "n", and in order to make the distance between the shafts short thereby reducing an area where the apparatus is set, it is preferable to be equal or greater than 100 mm.

Figure 5:
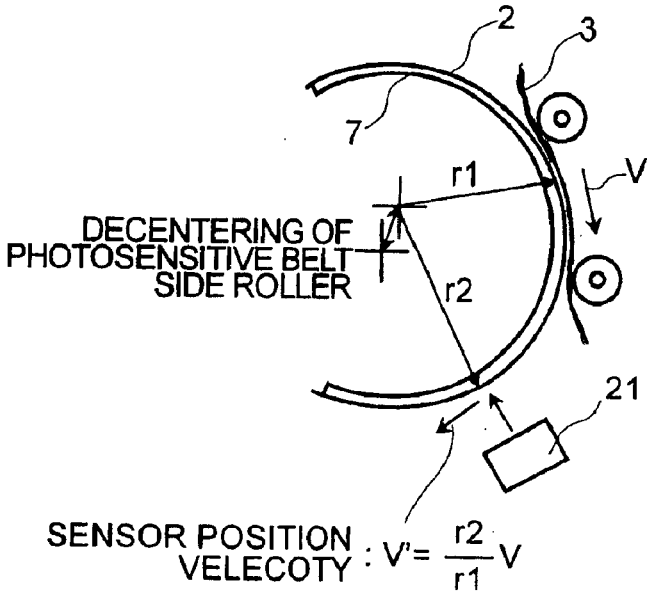
FIG. 5 is a view for explaining the cause of generating fluctuation in velocity, upon the position of a sensor, due to the decentering of the photosensitive belt side roller.
Figure 6:
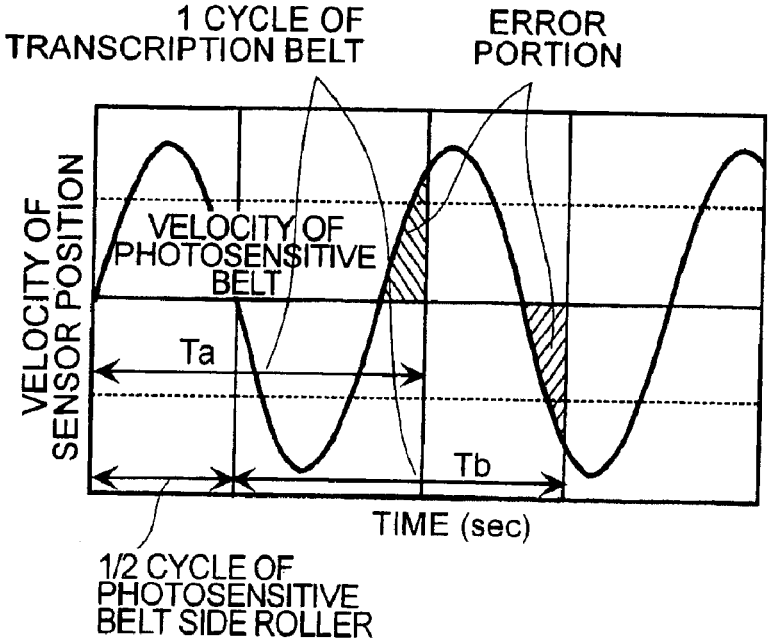
FIG. 6 is a view for showing the fluctuation in velocity, upon the position of a sensor, due to the decentering of the photosensitive belt side roller.

FIG. 5 is a view for showing mechanism for generating fluctuation on the internal transcription belt due to the decentering of the photosensitive belt side roller, in particular, at the sensor position, and FIG. 6 is a view for showing time-change of the speed of the internal transcription belt at that sensor potion. In FIG. 6, the vertical axis indicates the speed of the internal transcription belt, while the horizontal axis the time.

The internal transcription belt 2 is carried at the velocity V being same to that of the photosensitive belt 3, at the nip portion between the photosensitive belt 3. At the position of the sensor B 21, due to the radius r1 of the nip portion and that r2 of the position of the sensor B 21, the velocity V' of the internal transcription belt 2 comes to be (r2/r1)×V. Since r1 and r2 change periodically depending on the rotation of the photosensitive belt side roller 7, the velocity V' of the internal transcription belt 2 changes at one (1) cycle of the photosensitive belt side roller 7, as shown in FIG. 6. An amount of that change increases depending upon the degree of decentering of the photosensitive belt side roller 7. Herein, in a case where a ratio between the periphery lengths of the internal transcription belt 2 and the photosensitive belt side roller 7 is not an integer, such an error appears, as is indicated by a diagonal line portion in the figure. An area of this diagonal line portion comes to be an error in movement within a reference cycle of the internal transcription belt 2, and if it lies above the reference velocity, the marker advances much more. As a result thereof, the cycle detected comes to be fast. In this manner, even if the photosensitive belt 3 is carried at the reference velocity, the measured cycle of the internal transcription belt 2 changes in the cycle thereof, and if the speed of the motor 5 is compensated upon the basis of that cycle, it rather result in shift in piling of colors.

In the figure, assuming that the cycle of the internal transcription belt 2 to be measured at first is a first cycle Ta, and that a second cycle is Tb, on which the measurement starts after being delayed for ½ cycle of the photosensitive roller 7, then the error portion due to the velocity change at the position of the sensor B 21 is inverted, for Ta and Tb. An average value of those, (Ta+Tb)/2, is cancelled in the error portions, therefore it is possible to the correct cycle of the internal transcription belt 2.

According to the present embodiment, this cycle is obtained by means of the CPU 91, and the difference is calculated out between this cycle and the standard cycle, thereby compensating the speed of the motor 5 driving the photosensitive belt 3, depending upon that amount. As a result of this, it is possible to pile colors at high accuracy, but without the ill influences due to the decentering of the photosensitive belt side roller 7, thereby obtaining the high-quality image. For obtaining the image of much higher quality, it is preferable to bring the actual delay distance down to be "0" at the first digit below the decimal point thereof, assuming that ½ cycle of the photosensitive belt side roller 7 is "1".

Figure 7:
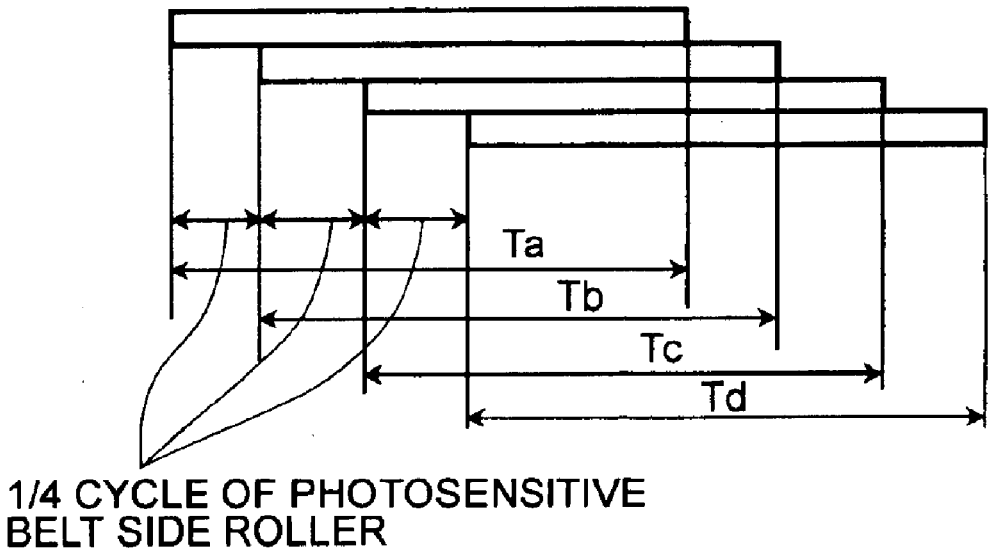
FIG. 7 is a view for showing a second method for averaging cycles.

FIG. 7 is a view for showing a second method for averaging the cycles according to the present invention.

Four (4) cycles, Ta, Tb, Tc and Td, are measured from starting of measurement of the cycle, delaying each by ¼ cycle of the photosensitive belt side roller 7. And, averaging by ½ cycle of the photosensitive belt side roller 7, TA=(Ta+Tc)/2 and TB=(Tb+Td)/2 are obtained. Averaging further, the reference cycle (TA+TB) is obtained, and thereby conducting the compensation of motor. Increasing the number of averaging in this manner, it is possible to reduce the measuring error. The cycle obtained may be further averaged, while increasing the number of averaging more, and conducting the averaging plural times by every ½ cycle of the photosensitive belt side roller.

Figure 8:
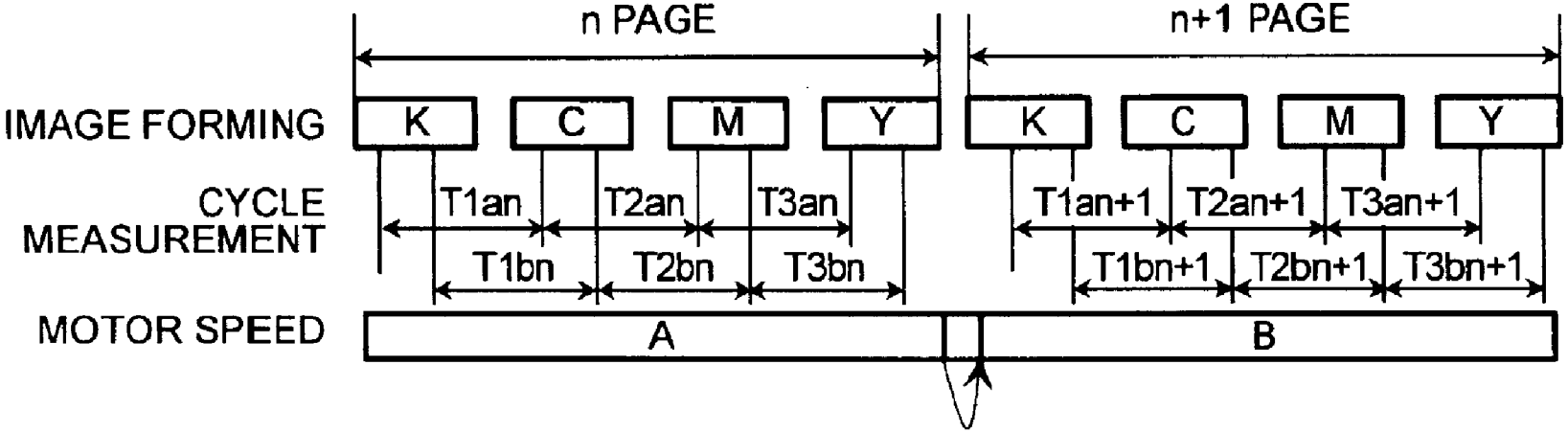
FIG. 8 is a conception view for explaining measurement of cycle of an internal transcription belt and adjustment of a motor speed in the image forming apparatus, according to the embodiment of the present invention.

FIG. 8 is a conception view of measurement of cycle of the internal transcription belt and compensation of motor speed when forming a color image in the image forming apparatus, according to the embodiment of the present invention.

It is assumed that forming of the images are conducted through exposure, in the orders, i.e., K (black), C (cyan), M (magenta) and Y (yellow). After starting the forming of image at nth page, measurement of the cycle T1*an*, and then T2*an* and T3*an* are measured, continuously. Delaying ½ cycle of the photosensitive belt side roller 7, T1*bn*, T2*bn* and T3*bn* are measured. From those values, an averaged cycle Tn=(T1*an*+T2*an*+T3*an*+T1*bn*+T2*bn*+T3*bn*)/6 is obtained, and the motor speed is changed from A to B upon the difference from the standard cycle. It is also possible to provide a tolerance range for the difference from the reference cycle, and the compensation makes no change if the difference lies within the tolerance range. For the next page, T1*an*+1, T2*an*+1, T3*an*+1, T1*bn*+1, T2*bn*+1 and T3*bn*+1 are measured, thereby to conduct the compensation.

For increasing the number of averaging, it is hard to receive the ill influences from the measuring error of the sensor B 21, etc., other than the decentering of the photosensitive belt side roller 7, therefore it is possible to obtain stable measurement of the cycle and pile-up of colors at high accuracy.

Figure 9:
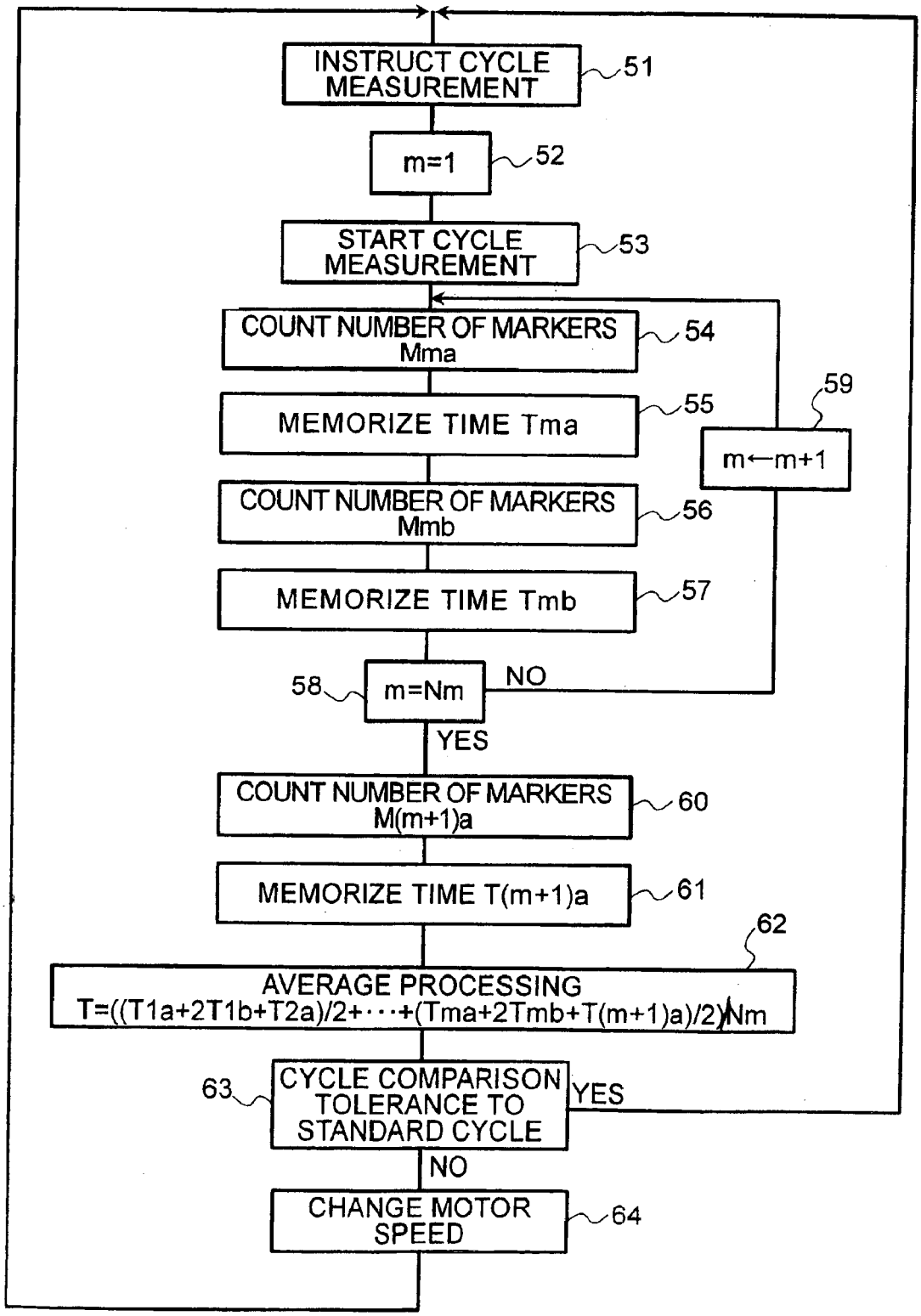
FIG. 9 is a flowchart for showing an algorithm for obtaining a reference cycle, according to the embodiment of the present invention.

FIG. 9 shows an algorithm for obtaining the reference cycle, according to the present invention.

First, upon an cycle measurement instruction (51) is cleared a cycle measurement time counter m (52), which count up for make compensation on the motor speed. Thereafter, the cycle measurement begins (53) from the marker, which the sensor B 21 detects first. The signal from the sensor B 21 is converted into a signal of "1" or "0" in the detection signal processing circuit 96, and the CPU 91 counts up the number Mma of markers for ½ cycle of the photosensitive belt side roller 7 (54). When detecting a predetermined number of the markers, that time Tma or the clock number corresponding to the time is memorized (55). Further continuously counting the number Mmb of remaining markers up to when corresponding to one cycle of the internal transcription belt 2 (56), and that time Tmb or the clock number corresponding to the time is memorized (57). Being compared to be a predetermined cycle measurement time Nm or not (58), "1" is added to "m" if it does not reach to that number (59), and further a passing time of the maker is measured. The predetermined cycle measurement time, Nm is "3", for example, in FIG. 8, and after measurement of this time, further the number of markers M(m+1) is counted for ½ cycle of the photosensitive belt side roller 7 (60), and that time T(m+1)a is memorized (61). And, averaging process is treated upon the marker count time memorized, thereby obtaining the reference cycle T for compensation of the motor speed (62).

This averaging process will be explained below.

A first cycle is T1*a*+T1*b*, and the cycle delayed by ½ cycle of the photosensitive belt side roller 7 is T1*b*+T2*a*. Therefore, the averaging for canceling the ill influences due to the decentering of the photosensitive belt side roller 7 is (T1*a*+T1*b*+T1*b*+T2*a*)/2. Averaging the cycles Nm times, the reference cycle is as follows:

$$T=\{(T1a+2T1b+T2a)/2+\ldots+(Tma+2Tmb+T(m+1)a)/2\}/Nm$$

Determining whether the difference, between this reference cycle T and the standard cycle, lies within the tolerance region or not (63), and the compensation is conducted, depending on necessity thereof, on the motor speed (64).

Figure 10:
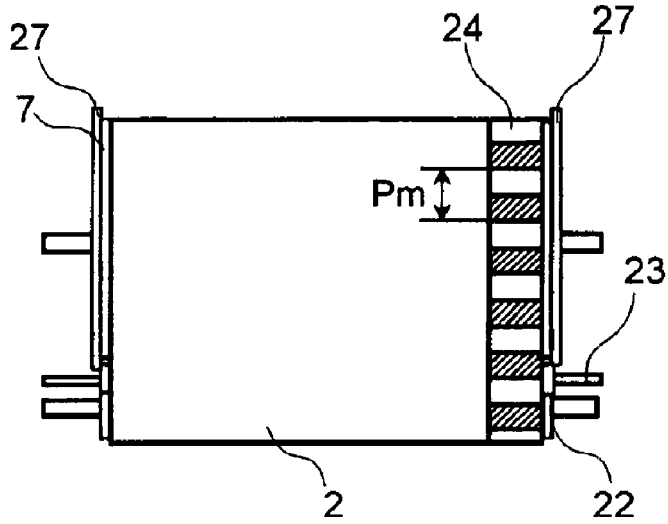
FIG. 10 is an upper view of a second internal transcription belt offset prevention mechanism in the image forming apparatus, according to the embodiment of the present invention.
Figure 11:
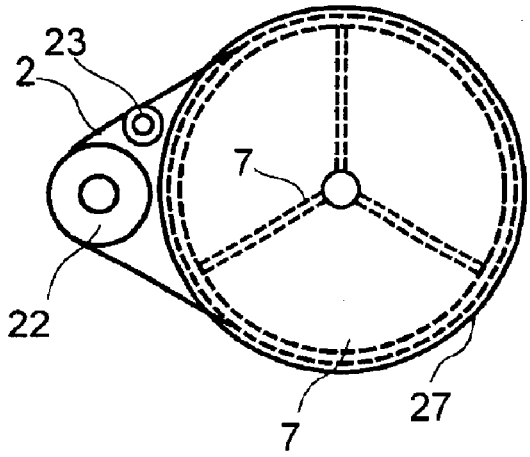
FIG. 11 is a side view of the second internal transcription belt offset prevention mechanism in the image forming apparatus, according to the embodiment of the present invention.

FIGS. 10 and 11 show an internal transcription belt from offset prevention mechanism, according to the embodiment of the present invention. FIG. 10 is an upper view in FIG. 1, and FIG. 11 a side view thereof.

In a case that the internal transcription belt 2 is offset, an edge portion thereof abuts on a flange portion 27 of the photosensitive belt side roller 7 on a side of the photosensitive belt 3, thereby stopping the offset. With provision of the flange portion 27 on the photosensitive belt side roller 7, which is large in the diameter and is long in the periphery length, the internal transcription belt 2 abuts on the flange portion 27 more than a half around of the edge portion thereof, when it is offset, and the contacting pressure can be reduced at the edge portion. Therefore, the internal transcription belt 2 is less damaged, and it can be used for a long time.

Also, rotating the flange together with the photosensitive belt side roller 7 reduce the load when the internal transcription belt 2 abuts on the flange at the edge portion thereof. With this, the carrying is stabilized and the accuracy of piling colors is improved,thereby improving the image quality.

The markers 24 formed in the internal transcription belt 2 are made up with the rectangular patterns having different reflectivity, being disposed alternately, and they are formed so that, the pitch Pm thereof comes to be 1/N (N: an integer) of ½ cycle of the photosensitive belt side roller 7. With this, it is possible to detect the ½ cycle of the photosensitive belt side roller 7 without error, and it is possible to conduct the speed compensation, more correctly. For the purpose of lessening this error within a range so that it gives no ill influence upon the image quality, it is preferable to bring that integer ratio between the ½ cycle of the photosensitive belt side roller 7 and the pitch Pm to be "0" at the first digit below the decimal point thereof.

As was fully explained in the above, according to the present invention, it is possible to accomplish the image forming apparatus, which is simple in the structure thereof and is able to record an image with high quality.

The present invention may be embodied in other specific forms without departing from the spirit or essential feature or characteristics thereof. The present embodiment(s) is/are therefore to be considered in all respects as illustrative and not restrictive, the scope of the invention being indicated by the appended claims rather than by the forgoing description and range-of equivalency of the claims are therefore to be embraces therein.

What is claimed is:

1. An image forming apparatus, comprising:

a photosensitive belt being carried by a driver device, for forming a toner image thereon;

an internal transcription belt for transcribing the toner image thereon, which is formed on said photosensitive belt; and a transcription portion for transcribing the toner image, which is transcribed on said internal transcription belt, onto a recording medium, further comprising:

a transcription side roller, being suspended with said internal transcription belt thereon, and disposed on a side of a photosensitive belt side roller, which is disposed on a side of said photosensitive belt, the transcription side roller being disposed on a side of said transcription portion; means for detecting a first cycle of said internal transcription belt; and means for detecting a second cycle, which starts measurement delaying by ½ cycle of said photosensitive belt side roller from the first cycle measurement start; a controller means for conducting speed compensation of said photosensitive belt by referring to said first cycle and said second cycle, wherein, said internal transcription belt is in contact with said photosensitive belt, so that it is carried following thereafter.

2. The image forming apparatus, as described in the claim 1, wherein a value obtained through driving length of said internal transcription belt by periphery length of said photosensitive belt side roller is shifted from an integer.

3. The image forming apparatus, as described in the claim 2, wherein a value obtained through driving length of said internal transcription belt by periphery length of said photosensitive belt side roller is greater than 1 and is less than 2.

4. The image forming apparatus, as described in the claim 1, wherein said controller means calculates compensation amount from an average cycle between the first cycle and the second cycle and a difference from a standard cycle of the internal transcription belt, thereby conducting the speed compensation of said photosensitive belt upon basis of said compensation amount calculated out.

5. The image forming apparatus, as described in the claim 4, wherein said controller means comprises a sensor for detecting a plural number of markers provided on said internal transcription belt, and means for detecting a cycle of said internal transcription belt from a marker detection signal of sensors provided as said means for detecting said first cycle and said means for detecting said second cycle, and said markers are disposed at an interval of 1/N (N: an integer) of the ½ cycle of said photosensitive belt side roller therebetween.

6. An image forming apparatus, comprising:

a photosensitive belt being carried by a driver device, for forming an toner image thereon;

an exposure device for forming an electrostatic image on said photosensitive belt;

a plural number of developer units for forming a toner image on said photosensitive belt;

a transcription roller for pushing a paper onto an internal transcription belt, so as to transcribe the toner image onto the paper;

a photosensitive belt side roller wound with said photosensitive belt therearound while putting said internal transcription belt therebetween, to be driven;

a transcription side roller being pushed with the paper while putting said internal transcription belt therebetween;

a plural number of markers formed in said internal transcription belt;

a sensor for detecting said markers; and a calculation means for measuring a first cycle of said internal transcription belt and a second cycle for starting measurement delaying by ½ cycle of said photosensitive belt side roller from the first cycle measurement start, from a marker detection signal of said sensor, for calculating out a compensation amount from an average cycle of said first cycle and said second cycle and a difference with respect to a standard cycle, and for controlling said driver device upon basis of said compensation amount, thereby compensating a carry speed of said photosensitive belt, wherein, said internal transcription belt is suspended round said photosensitive belt side roller and said transcription side roller, and is in contact with said photosensitive belt, to be carried following thereafter, and the toner images on said photosensitive belt are transcribed on surface of said internal transcription belt, piling up thereupon by a plural number of times, when forming an image for one (1) page.

7. The image forming apparatus, as described in the claim 6, wherein the speed compensation is conducted by the average cycle of said first cycle and said second cycle and the difference with respect to the standard cycle.

8. The image forming apparatus, as described in the claim 7, wherein the distance of said markers is 1/N (N: an integer) of the ½ cycle of said photosensitive belt side roller.

9. The image forming apparatus, as described in either one of the claims 7 and 8, wherein d1>d2, assuming that a diameter of said photosensitive belt side roller is d1 and that of said transcription side roller is d2.

* * * * *